United States Patent [19]

Bieg et al.

[11] 4,369,683

[45] Jan. 25, 1983

[54] DISCHARGING DEVICE FOR AN EXTRUSION PRESS

[75] Inventors: Hartmut Bieg, Augsburg; Hans Jonas, Gersthofen, both of Fed. Rep. of Germany; Heinz Rosswurm, Hickman, Ky.; Wilhelm Demmer, Frankfurt am Main; Ludwig Döbel, Darmstadt-Arheilgen, both of Fed. Rep. of Germany

[73] Assignee: Sigri Elektrographit GmbH, Meitingen bei Augsburg, Fed. Rep. of Germany

[21] Appl. No.: 247,815

[22] Filed: Mar. 26, 1981

[30] Foreign Application Priority Data

Dec. 9, 1980 [DE] Fed. Rep. of Germany ..... 3046270

[51] Int. Cl.[3] ..... B30B 11/06; B28B 11/16

[52] U.S. Cl. ..... 83/157; 83/79; 83/110; 83/289; 83/293; 83/320

[58] Field of Search ..... 83/79, 110, 157, 289, 83/293–295, 318–320

[56] References Cited

U.S. PATENT DOCUMENTS

| | | | |
|---|---|---|---|
| 1,583,188 | 5/1926 | Schumacher | 83/318 |
| 2,171,954 | 9/1939 | Sorensen et al. | 83/318 |
| 3,174,373 | 3/1965 | Gensman | 83/157 X |
| 3,306,144 | 2/1967 | Norgren | 83/319 X |

*Primary Examiner*—James M. Meister

*Attorney, Agent, or Firm*—Herbert L. Lerner; Laurence A. Greenberg

[57] ABSTRACT

Discharging device for an extrusion press, including a frame being movable in the axial direction of the press; a first part being connected to the frame and adjustable in height, the first part including a substantially flat plate and cutting means; a second part being movable relative to the frame and being adjustable in height, the second part including a horizontally disposed axle, a conveyor belt being suspended from the axle and tiltable about the axis of the press, and a coupling for the conveyor belt; a coupling rod for the cutting means being engageable with the coupling for periodically connecting the cutting means to the conveyor belt; and a continuously variable drive driving the conveyor belt.

3 Claims, 4 Drawing Figures

DISCHARGING DEVICE FOR AN EXTRUSION PRESS

The invention relates to a discharging device for an extrusion press, especially for forming carbon electrodes, with cutting means which can be moved in the direction of the press axis.

In extruding plastic materials, it is generally necessary to cut the extruded material into smaller sections which are appropriate for further processing and use. If during the cutting process the extruded material bolt and the cutting means have different velocities, relative to the press for instance, deformations of the extruded material will of necessity occur. This is true particularly in the case of blanks for the manufacture of carbon electrodes, having a forming temperature which is higher than the softening temperature of the binder contained in the extrusion. A velocity difference between the extruded material and the cutting means and coincident detrimental deformations of the extruded material can be avoided in a simple manner, if the press is periodically stopped and the extrusion is cut apart during the rest periods. The shortcomings of this process, such as low throughput rate and structural faults in the extruded material due to the periodic changes of the press velocity, require no explanation and there has therefore been no lack of attempts to perform the cutting on the moving extrusion. A discharging device with a cutting member has become known from German Published Non-Prosecuted Application DE-OS No. 22 08 470. The device shown in that application is moved during the cutting operation parallel to and approximately synchronously with the emerging extrusion, and is returned after the cut to the starting position. The support for the extrusion is constructed therein as a tipping carriage, which moves the cut-off section of the extrusion away from the press with high velocity and pushes back into the starting position reversing the velocity, after the section has been rolled off. The movements are released by a signal generator and are performed by two simultaneously acted-upon hydraulic cylinders. Because of the large mass and the high acceleration, this device operates relatively sluggishly, so that the possible extrusion velocity remains relatively low. Other disadvantages are the large amount of power required and the difficulty of equalizing variations in the extrusion velocity.

It is accordingly an object of the invention to provide a discharging device for an extrusion press, which overcomes the hereinafore-mentioned disadvantages of the heretofore-known devices of this general type and to completely avoid deformations of sections of an extrusion by having the extrusion velocity better approach the velocity of the cutting means; to increase the permissible extrusion velocity by increasing the cutting frequency; and to reduce the amount of power required. According to another object, the possibility of deformation of cut-off sections during setting down or rolling off from the conveyor means is to be eliminated.

With the foregoing and other objects in view there is provided, in accordance with the invention, a discharging device for an extrusion press, especially for forming carbon electrodes, with cutting means that can be moved in the axial direction of the press, comprising a frame being movable in the axial direction of the press; a first part being connected to the frame and adjustable in height, the first part including a substantially flat plate and cutting means; a second part being movable relative to the frame and being adjustable in height, the second part including a horizontally disposed axle or pin, a conveyor belt being suspended from the axle and tiltable about the axis of the press, and a coupling for the conveyor belt, a coupling rod for the cutting means being engageable with the coupling for periodically connecting the cutting means to the conveyor belt; and a continuously variable drive driving the conveyor belt.

The mobility of the base frame makes it possible to move the frame as a support of the discharging device, to that, for instance, the orifice can be exchanged periodically and can be closed by a plug without special effort. For this purpose, the frame is constructed in the form of runners or is advantageously provided with trackguided wheels. Connected to the frame is a flat plate which is adjustable in height, serves as the discharge table, and is advantageously constructed as a cantilevered table. The guide means are guide rods, for instance, for the cutting means, which are periodically moved in and against the extrusion direction. In accordance with another feature of the invention, the conveyor belt is a trough-shaped belt having depressed plates. The conveyor belt which is aligned with the discharge table and is advantageously constructed as a trough or wedge-shaped, depressed plate belt is preferably suspended in a rocker.

In accordance with a concomitant feature of the invention, the axle or pin is concentric or coaxial with extruded material in the press, i.e. the rocking axis of the rocker is adjusted for the longitudinal axis of the extrusion. The conveyor belt which is driven, for instance, by sprocket wheels and is depressed in trough or wedge-fashion for better lateral guidance of the cut-off sections of the extrusion, is adjustable in the vertical direction, so that the height of the conveyor belt as well as the height of the discharge table can be adjusted as required by the diameter of the extrusion, and the tilting axis always coincides with the axis of the extrusion, as explained above.

The cutting means includes movable cutting knives which are driven by hydraulic cylinders and are suspended in the cutting frame. The cutting frame is held by guide rods and is moved periodically by coupling it to the conveyor belt synchronously with the belt in the extrusion direction, and after decoupling, in the opposite direction, by means of a hydraulic cylinder. It is advantageous if the guide rods are held in such a manner that the cutting frame can be brought all the way to the press orifice in its return motion. Cuts adjacent to the orifice reduce waste if the press is freshly charged. For controlling the operation, the device contains measuring sensors, signal generators and control devices.

Other features which are considered as characteristic for the invention are set forth in the appended claims.

Although the invention is illustrated and described herein as embodied in a discharging device for an extrusion press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
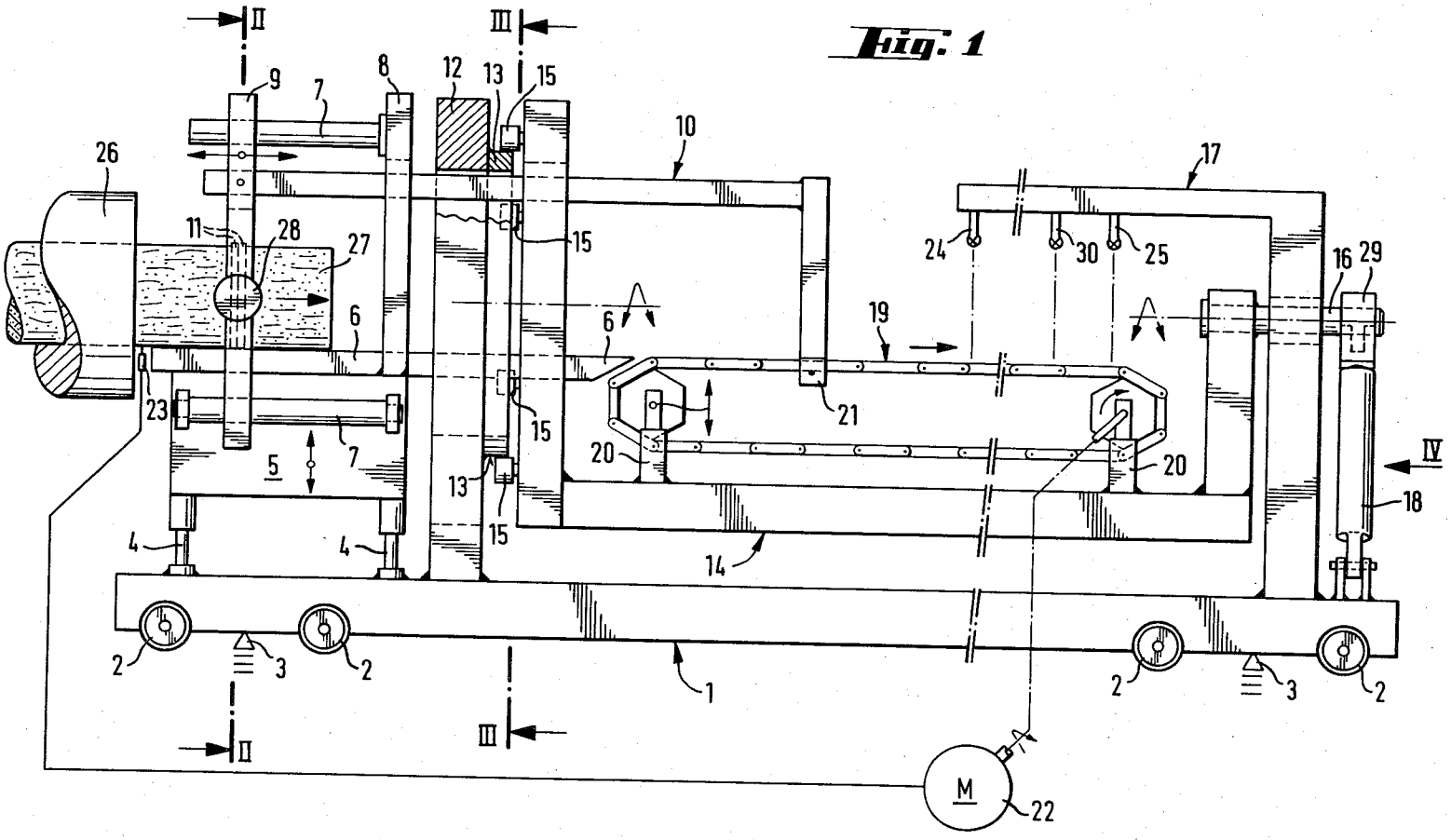
FIG. 1 is a fragmentary, diagrammatic side elevational view of the discharging device according to the invention.
Figure 2:
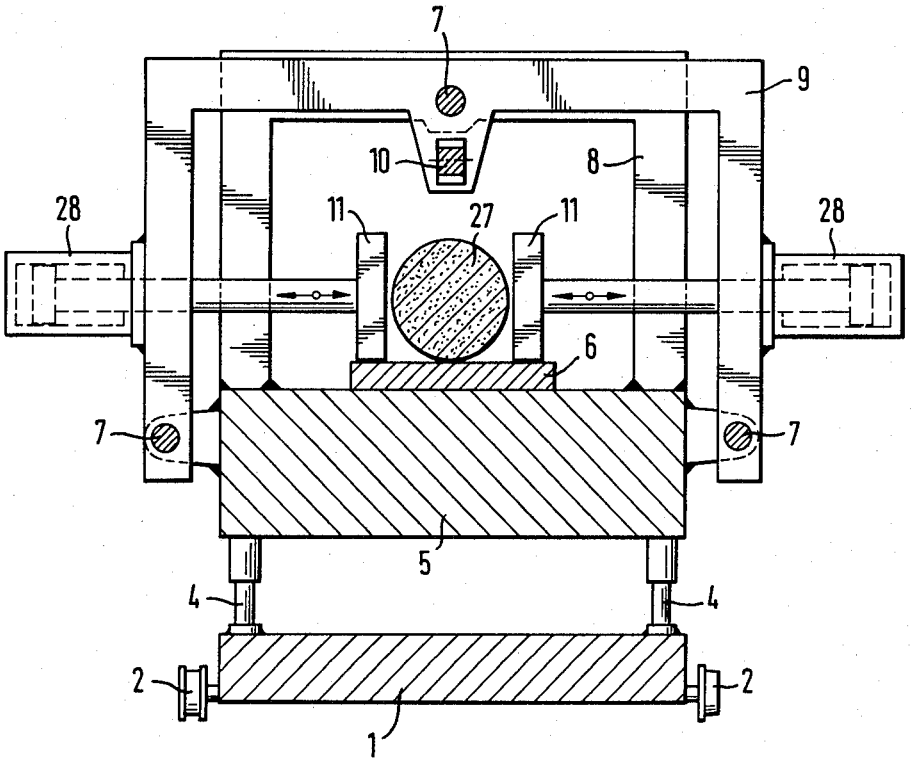
FIG. 2 is a cross-sectional view taken along the line II—II in FIG. 1, in the direction of the arrows.
Figure 3:
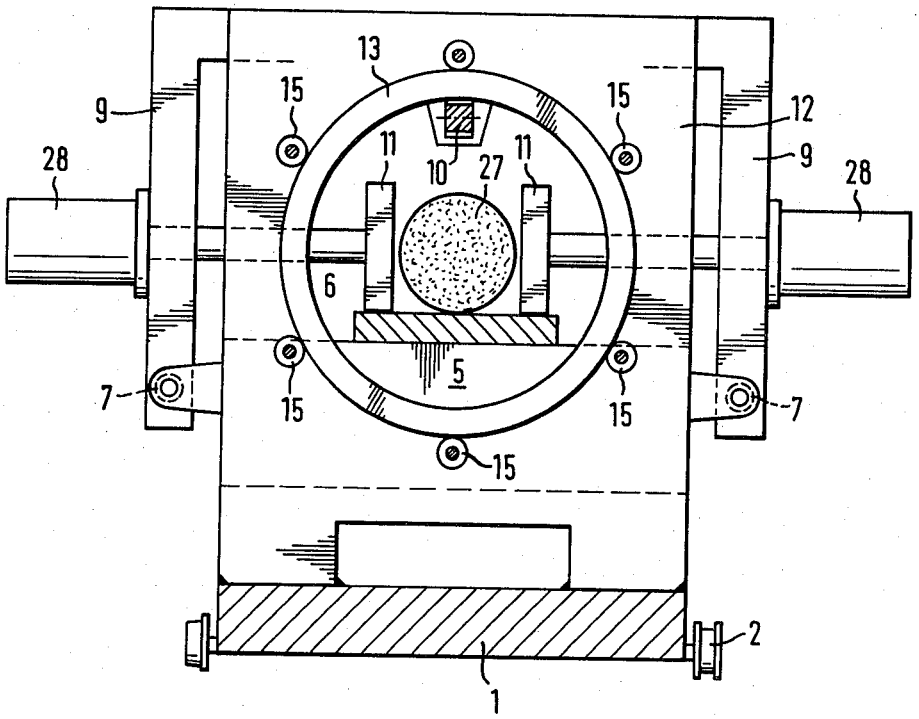
FIG. 3 is a cross-sectional view taken along the line III—III in FIG. 1, in the direction of the arrows.
Figure 4:
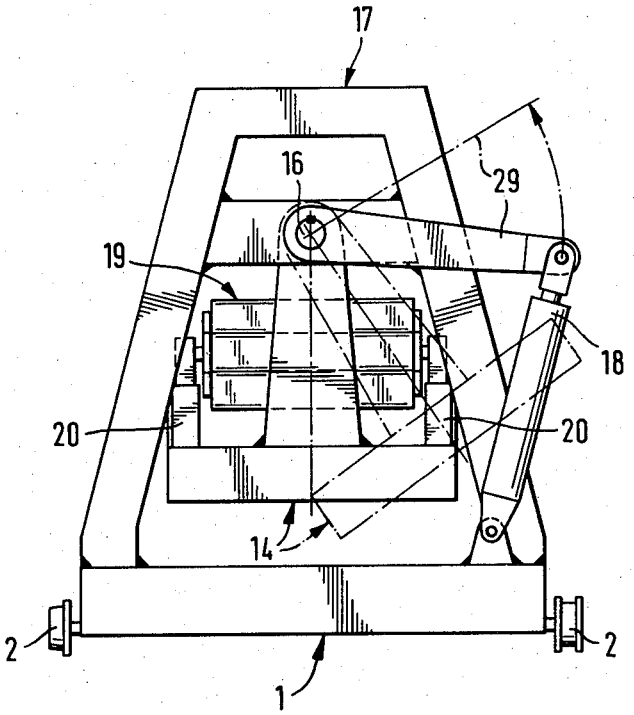
FIG. 4 is a partial view taken along the direction of the arrow IV in FIG. 1.

Referring now particularly to the figures of the drawing as a whole, it is seen that the frame 1 of the discharging device is equipped with wheel sets 2 and arresting means 3, which allow motion in the extrusion direction and fixation of the device. The wheel sets are guided by tracks in a manner which is known but not shown in the drawing. Welded to the frame 1 are height-adjustable columns 4, which support a discharging table 5. The table 5 is covered by an overhanging plate 6, which is depressed in trough-fashion at the conveyer end. Firmly connected to the table 5 are guide rods 7 which guide a cutting frame 9 and a coupling rod 10 connected to the cutting frame, as well as a portal 8. The cutting frame 9 which is movable in the horizontal direction contains cutting knives 11 and hydraulic cylinders 28 best seen in FIG. 2. The portal 12 which is best seen in FIG. 3 is welded to the frame 1 and is provided with a rotating ring 13. A tilting frame for the rocker 14 shown in FIGS. 1 and 4 is braced through roller 15 against the ring 13. The rocker 14 is hung into the bearing block 17 with a pin 16. A hydraulic cylinder 18 which causes the tilting motion of the rocker engages the post 16 through a lever arm 29. A conveyor belt 19 is connected by height-adjustable holders 20 to the frame of the rocker 14, and the belt 19 is also connected periodically by the coupling 21 through the coupling rod 10 to the cutting frame 9. The drive 22 of the conveyor belt 19 is controlled by a signal generator 23. Signal generators 24 and 25 release the cutting process and the tilting of the rocker.

An extrusion 27 extruded from an orifice 26 of an extrusion press which is not shown in the drawing, is supported on the plate 6 of the discharging table 5. The velocity of the extrusion is measured by the signal generator 23 for the drive 22, for instance through a friction wheel extending over the surface or over the discharging table. The discharge velocity, converted into suitable pulses, controls the speed of the drive 22 and the speed of the conveyor belt 19. Hand operated control drives are sufficient for setting the conveyor belt speed if the velocity of the extrusion 27 is approximately constant. In that case, sufficiently accurate adaption of the belt velocity to the discharge velocity of the extrusion is possible with these simple means. The extrusion moves from the discharging table toward the conveyor belt 19 and encounters the signal generator 24, which may be a light gate, for instance. The end of the table 5 facing away from the press is optionally constructed in the form of a tray or prism for guiding the extrusion. The signal releases the engagement of the coupling rod 10 with the coupling 21 so that the cutting frame 9 is moved with the velocity of the conveyor belt in the direction of the emerging extrusion. The cutting knives 11 are simultaneously pressed by the hydraulic cylinder 28 against the extrusion so that they cut off a first section, the length of which can be controlled by setting the signal generator. After the cut, the cutting knives and the coupling open and the cutting frame 9 is returned to the starting position. The head of the cut-off section then reaches the signal generator 30, which is likewise preferably a light gate, and the speed of the drive 22 and the belt 19 are uniformly increased to a predetermined value, so that the cut-off section is moved away from the extrusion. The signal generator 25 triggers a tilting motion of the rocker 14 about the post 16 through the hydraulic cylinder 18. On the opposite side, the rocker rolls onto the rotating ring 13 by way of the rollers 15. The belt velocity is simultaneously reduced to the starting value or to zero. According to another embodiment, the opening of the cutting knives 11 controlled by end switches, is directly coupled to the acceleration of the conveyor belt, and according to a further embodiment the tilting motion of the rocker is initiated by decoupling the drive 22. In that case, the drive is fastened to the frame 1.

During the tilting motion, the cut-off section rolls from the conveyor belt over an inclined plane into a water bath, in which the section is cooled down to a temperature facilitating handling. In the meantime, the cylinder 18 swings the rocker 14 with the conveyor belt back into the starting position, the velocity of the belt 19 being adjusted to the exit velocity of the extrusion, and the cycle starts anew.

It is a substantial advantage of the discharging device according to the invention that even relatively plastic extrusions, such as carbon blanks, can be cut into sections without deforming the extrusion, and rolled into a cooling tank. Deformations during the cutting are prevented by the agreement of the discharging velocity and the belt velocity and the coupling of the cutting frame to the conveyor belt. Deformations during rolling-off are prevented by rotating the cut-off extrusion section about its longitudinal axis. Since the belt velocity can be increased practically without delay and with a small amount of power after the cut, the device permits high discharging velocities. As compared with known devices, higher extrusion velocities are achieved with the discharge device according to the invention and lower reject rates are achieved because deformations are avoided.

There is claimed:

1. Discharging device for an extrusion press, comprising a frame being movable in the axial direction of the press; a first part being connected to said frame and adjustable in height, said first part including a substantially flat plate and cutting means; a second part being movable relative to said frame and being adjustable in height, said second part including a horizontally disposed axle, a conveyor belt being suspended from said axle and tiltable about the axis of the press, and a coupling for said conveyor belt; a coupling rod for said cutting means being engageable with said coupling for periodically connecting said cutting means to said conveyor belt; and a continuously variable drive driving said conveyor belt.

2. Discharging device according to claim 1, wherein said conveyor belt is a trough-shaped belt having depressed plates.

3. Discharging device according to claim 2, wherein said axle is concentric with extruded material in the press.

* * * * *